US005632510A

United States Patent [19]

Morowitz

[11] Patent Number: 5,632,510

[45] Date of Patent: May 27, 1997

[54] FOOD PREPARATION FACILITATOR APPARATUS

[75] Inventor: Arthur Morowitz, Short Hills, N.J.

[73] Assignee: Evart Enterprises, Inc., New York, N.Y.

[21] Appl. No.: 428,273

[22] Filed: Apr. 25, 1995

[51] Int. Cl.[6] ..... B42D 15/00

[52] U.S. Cl. ..... 283/61; 283/115; 283/117; 283/900

[58] Field of Search ..... 283/61, 62, 900, 283/115, 116, 65, 117

[56] References Cited

U.S. PATENT DOCUMENTS

| | | | |
|---|---|---|---|
| 5,096,228 | 3/1992 | Rinderknecht | 283/900 X |
| 5,178,416 | 1/1993 | Wennik | 283/900 X |
| 5,451,079 | 9/1995 | Gong et al. | 283/900 X |

OTHER PUBLICATIONS

Trademark Registration No. 1,526,886 (1989).
Trademark Registration No. 937,108 (1972).

*Primary Examiner*—Willmon Fridie, Jr.
*Attorney, Agent, or Firm*—Amster, Rothstein & Ebenstein

[57] ABSTRACT

An internationally useful kit for advising a waiter of dietary restrictions comprises a plurality of cards and an organizer. Each of the cards is associated with a respective dietary restriction and contains both an internationally recognizable graphic representation of the respective dietary restriction, and translations of the respective dietary restriction into a plurality of languages. Thus, each card identifies a respective dietary restriction both graphically and in a plurality of languages. The organizer releasably receives and maintains the plurality of cards, preferably in such a manner as to enable different sets of the plurality of cards to be used at different times to advise a waiter of the then applicable dietary restrictions.

7 Claims, 1 Drawing Sheet

FIG. 1
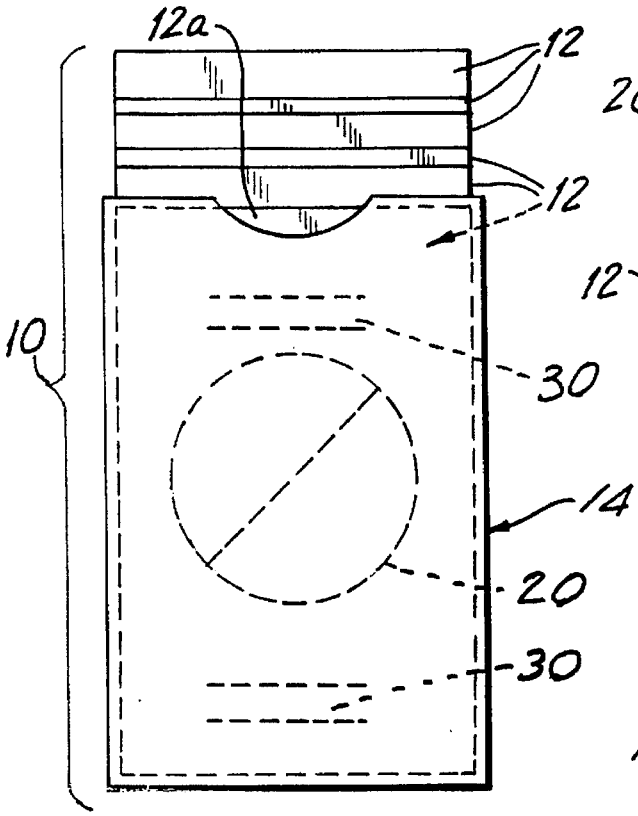
FIG. 2
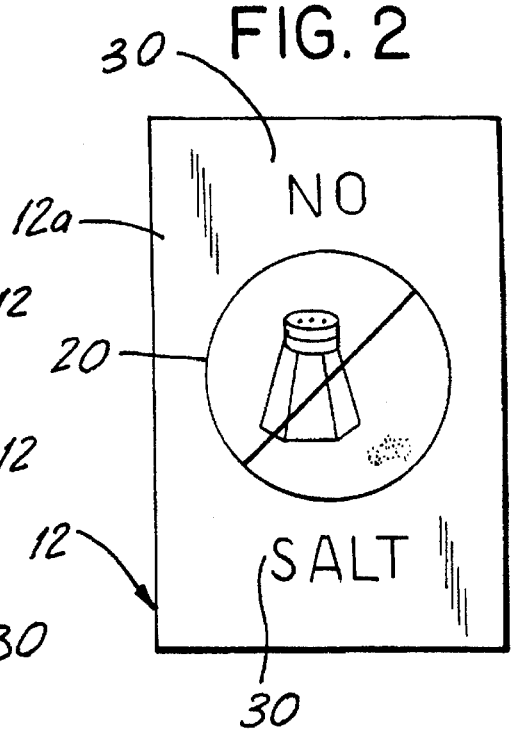
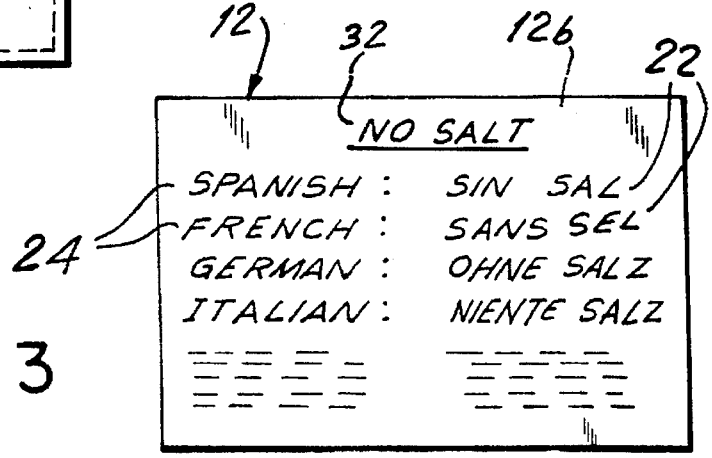
FIG. 3

FOOD PREPARATION FACILITATOR APPARATUS

BACKGROUND OF THE INVENTION

The present invention relates generally to a food preparation facilitator apparatus and, more particularly, such apparatus which facilitates advising a food preparer of applicable dietary restrictions.

When a diner in a restaurant speaks the local language, he is usually able to appropriately advise the waiter of his dietary restrictions, the waiter then reporting the dietary restrictions to the kitchen where the food will be prepared accordingly. These dietary restrictions may be religious in nature (e.g., "kosher only" or "vegetarian only"), medical (e.g., "no cholesterol," "no eggs," "no hot peppers," "no cheese," or "no shellfish"), or simply matters of taste preference (e.g., "meat well-done" or "meat rare"). However, as one travels internationally (or simply goes into local "foreign food" restaurants where the waiters are not conversant with the local language), it becomes difficult to communicate the applicable dietary restrictions to the waiter, thereby diminishing any chance of compliance with such dietary restrictions by the kitchen. There are many different languages, some of which do not even use the English alphabet, and few people are able to express even one or two dietary restrictions in all of the languages which may be required in their travels.

Accordingly, an object of the present invention is to provide an internationally useful kit for advising a waiter (locally or internationally) of dietary restrictions (whether arising out of religion, health or preference).

Another object is to provide such a kit which enables the user to advise the waiter of dietary restrictions by means of a card containing an internationally recognizable graphic representation of the dietary restriction, as well as a translation of the dietary restriction into a plurality of languages.

A further object is to provide such a kit which includes an organizer for releasably receiving and maintaining the plurality of cards representing respective dietary restrictions in such a manner as to enable different sets of the plurality of cards to be used at different times to advise a waiter of the then applicable dietary restrictions.

SUMMARY OF THE INVENTION

It has now been found that the above and related objects of the present invention are obtained in an internationally useful kit for advising a waiter of dietary restrictions. The kit comprises a plurality of cards and organizer means for releasably receiving and organizing the plurality of cards. Each of the cards is associated with a respective dietary restriction and contains both an internationally recognizable graphic representation of the respective dietary restriction and translations of the respective dietary restriction into a plurality of languages. Thus, each card identifies a respective dietary restriction both graphically and in a plurality of languages.

In a preferred embodiment, each of the cards associated with a respective dietary restriction has front and back faces and contains, on the front face, the internationally recognizable graphic representation of the respective dietary restriction, and, on the back face, the translations of the respective dietary restriction into the plurality of languages. Typically, the plurality of cards is at least 26, and the plurality of languages is at least 20. Each card preferably contains associated with each translation, a designation of the language thereof, thereby facilitating a user determining the appropriate translation to be indicated to a waiter. At least some of the internationally recognizable graphic representations comprise a representation of a food product or an image associated therewith, surrounded by a circle with a slash therethrough, whereby the graphic representation consists of an international prohibition symbol with the food product or associated image representation shown therebeneath. The cards and the organizer are conveniently configured and dimensioned as conventional business cards and a business card organizer or container.

The present invention also encompasses a kit wherein the cards identify the respective dietary restriction graphically, in a plurality of languages or both, and the organizer means enables different sets of the plurality of cards to be used at different times to advise a waiter of then applicable dietary restrictions.

BRIEF DESCRIPTION OF THE DRAWING

The above and related objects, features and advantages of the present invention will be more fully understood by reference to the following detailed description of the presently preferred, albeit illustrative, embodiment of the present invention when taken in conjunction with the accompanying drawing wherein:

FIG. 1 is a front elevational view of a kit according to the present invention, with some of the cards being illustrated partially removed from the organizer;

FIG. 2 is a front elevational view of a card; and

FIG. 3 is a back elevational view of the card of FIG. 2.

DETAILED DESCRIPTION OF THE PREFERRED EMBODIMENTS

Referring now to FIG. 1, therein illustrated is a kit according to the present invention, generally designated by the reference numeral 10. The kit 10 is internationally useful for advising a waiter of dietary restrictions and comprises a plurality of cards, generally designated 12, and an organizer, generally designated 14, for releasably receiving and maintaining the plurality of cards 12. While six cards 12 are visible in FIG. 1, preferably a kit will have at least 26 cards so that each of the cards 12 can be associated with a respective dietary restriction: no salt, no caffeine, no cholesterol, no alcohol, no spices, no dairy, no onion, no garlic, no wheat, no eggs, no MSG, no beef, vegetarian only, meat well-done, no hot peppers, no cheese, no chocolate, meat medium, kosher only, no shellfish, meat rare, no sugar, no butter, no pork, low fat, no oil, or the like. It will be appreciated that while the food restrictions are typically exclusionary and involve the prohibitory word "no", this is not always the case (see "vegetarian only," "kosher only," and "well-done," "medium" or "rare" meat). In order to reduce the size and weight of the kit 10 being carried on a trip, those cards indicating dietary restrictions which are of no interest at any time to a particular individual (or his travelling companions) may be removed from the organizer 14 for the duration of the trip or permanently.

In the preferred embodiment illustrated, each card 12 identifies a dietary restriction both graphically (see FIG. 2) and in a plurality of languages (see FIG. 3). More particularly, each card 12 contains an internationally recognizable graphic representation 20 of the respective dietary restriction and translations 22 of the respective dietary restriction into a plurality (say, 20) of languages—for example, Spanish, French, German, Italian, Portuguese, Dutch, Swedish, Norwegian, Danish, Finnish, Czech, Hungarian, Russian, Polish, Bulgarian, Hebrew, Arabic, Japanese, Chinese, Korean, and the like. It will be appreciated that while some of these different languages may use the English language alphabet, others may not. Preferably, associated with each translation is a designation 24 of the language thereof, thereby to facilitate a user determining the appropriate translation to be indicated to a waiter and even permitting the user to attempt to pronounce the translation itself.

At least some of the preferred internationally recognizable graphic representations 20 comprise a representation of a food product or an image associated therewith, surrounded by a circle with a slash therethrough. Thus, the graphic representation 20 consists of an international prohibition symbol with the food product or associated image representation shown therebeneath (that is, with the slash line in front of or overlaying the food product or associated image representation). While this type of representation is well suited for negative dietary requirements involving the prohibitory word "no", it is not well suited for other types of dietary requirements, such as how one wishes his meat cooked. In this instance, a card may represent a piece of meat cooked to the desired degree (juicy red, pink or blackened).

Some ingenuity and communication skills may be gainfully employed in selecting appropriate graphics for use on a card. For example, a "vegetarian only" representation might have a piece of meat and a leafy vegetable depicted on the card, with the international prohibition symbol disposed only over the meat. For dietary restrictions applicable to a plurality of food products—for example, for "no shellfish"—the international prohibition symbol may be placed over a plate having thereon a variety of shellfish, such as crabs, shrimp, lobster, mussels, and the like. Presumably, any indefiniteness in the graphic representation of the dietary restriction can be clarified for the waiter by reference to the translation thereof into the appropriate foreign language.

Each card 12 has a front face 12*a* and a back face 12*b*. Preferably, each card 12 will contain, on the front face 12*a* thereof, the internationally recognized or graphic representation of the respective dietary restriction and, on the back face 12*b* thereof, the translations of the respective dietary restriction into the plurality of languages. However, the present invention also encompasses the internationally useful kit for advising a waiter of dietary restrictions, wherein each of the cards identifies the associated respective dietary restriction graphically or in a plurality of languages rather than by both techniques.

Where the kit is to be sold to users having as their main language English (or any other given language), the dietary restriction is preferably set forth in English (or the other given language) on the same front face 12*a* of the card as the graphic representation 20 (as shown at 30 in FIG. 2) and at the top of the list of translations into foreign languages on the back of the card (as illustrated at 32 in FIG. 3).

The cards 12 and the organizer 14 are preferably configured and dimensioned as conventional business cards (including wallet-size business cards), and a business card organizer or holder, although other sizes and configurations may be employed for particular applications.

In the preferred embodiment of the present invention illustrated, the organizer 14 enables different sets of the plurality of cards 12 to be used at different times to advise a waiter of the then applicable dietary restrictions. Thus, a particular user may always wish to respect the "no salt" and "no egg" restrictions for health reasons, but only on occasion respect a "no garlic" restriction (e.g., when dining with companions who might object). Accordingly, after initially removing from the organizer 14 those cards 12 bearing dietary restrictions of no possible interest, he might carry in the organizer 14 simply the three cards 12 referenced, at times removing two of the cards to appropriately advise the waiter and, at other times, removing all three cards to appropriately advise the waiter. The organizer 14 may be any of a variety of pouches open at one end, openable boxes, or like apparatus for acting as a business card organizer or holder. Preferably, the cards will identify the respective dietary restrictions graphically, in a plurality of languages, or both.

The cards 12 and organizer 14 may be formed of paperboard or the like, preferably with a clear plastic coating thereover to prevent the cards from becoming soiled at the dinner table.

To summarize, the present invention provides an internationally useful kit for advising a waiter of dietary restrictions, the kit employing cards identifying respective dietary restrictions preferably both graphically and in a plurality of languages. The organizer means enables different sets of the plurality of cards to be used at different times to advise a waiter of then applicable dietary restrictions.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An internationally useful kit for advising a waiter of dietary restrictions, comprising:

(A) a plurality of cards, each of said cards being associated with a respective dietary restriction and containing:

(i) an internationally recognizable graphic representation of the respective dietary restriction, and (ii) translations of the respective dietary restriction into a plurality of languages; and (B) organizer means for releasably receiving and maintaining said plurality of cards;

whereby each card identifies a respective dietary restriction both graphically and in a plurality of languages.

2. The kit of claim 1 wherein each card contains associated with each translation, a designation of the language thereof, thereby facilitating a user determining the appropriate translation to be indicated to a waiter.

3. The kit of claim 1 wherein each of said cards associated with a respective dietary restriction has front and back faces and contains:

(i) on said front face, said internationally recognizable graphic representation of the respective dietary restriction, and (ii) on said back face, said translations of the respective dietary restriction into said plurality of languages.

4. The kit of claim 1 wherein said plurality of cards is at least 26, and said plurality of languages is at least 20.

5. The kit of claim 1 wherein at least some of said internationally recognizable graphic representations comprise a representation of a food product or an image associated therewith, surrounded by a circle with a slash therethrough;

whereby said graphic representation consists of an international prohibition symbol with the food product or associated image representation shown therebeneath.

6. The kit of claim 1 wherein said cards and said organizer means are configured and dimensioned as conventional business cards and a business card organizer.

7. An internationally useful kit for advising a waiter of dietary restrictions, comprising:

(A) a plurality of cards having front and back faces, each of said cards being associated with a respective dietary restriction and containing:

(i) on said front face, the respective dietary restriction in one language and an internationally recognizable graphic representation thereof, at least some of said internationally recognizable graphic representations including a representation of a food product or an image associated therewith, surrounded by a circle with a slash therethrough, whereby said graphic representation consists of an international prohibition symbol with the food product or image representation shown therebeneath; and (ii) on said back face, translations of the respective dietary restriction into a plurality of languages, and, associated with each translation, a designation of the language thereof, thereby facilitating a user determining the appropriate translation to be indicated to a waiter;

whereby each card identifies a respective dietary restriction both graphically and in a plurality of languages; and (B) organizer means for releasably receiving and maintaining said plurality of cards in such a manner as to enable different sets of said plurality of cards to be used at different times to advise a waiter of then applicable dietary restrictions, said cards and said organizer means being configured and dimensioned as a conventional business card and business card organizer.

* * * * *